United States Patent [19]

Matuura

[11] Patent Number: 4,826,002

[45] Date of Patent: May 2, 1989

[54] KEY CASE

[76] Inventor: Syozi Matuura, 22-22, Chitosedai 2-chome, Setagaya-ku, Tokyo, Japan

[21] Appl. No.: 119,549

[22] Filed: Nov. 12, 1987

[30] Foreign Application Priority Data

Nov. 18, 1986 [JP] Japan ..... 61-177146

[51] Int. Cl.[4] ..... A45C 11/00

[52] U.S. Cl. ..... 206/37.2; 206/37.4; 206/37.3

[58] Field of Search ..... 206/37.2, 37.3, 37.1, 206/37.4

[56] References Cited

U.S. PATENT DOCUMENTS

| | | | |
|---|---|---|---|
| 1,936,273 | 11/1933 | Segal | 206/37.2 |
| 2,313,485 | 3/1943 | Stiller | 206/37.3 |
| 2,605,802 | 8/1952 | Baldwin | 206/37.4 |
| 3,101,762 | 8/1963 | Bermingham et al. | 206/37.3 |
| 3,119,429 | 1/1964 | Stiller et al. | 206/37.3 |
| 3,209,479 | 10/1965 | Manzardo | 206/37.1 |
| 3,406,546 | 10/1968 | Clement | 206/37.3 |

FOREIGN PATENT DOCUMENTS

| | | | |
|---|---|---|---|
| 374964 | 1/1940 | Italy | 206/37.1 |

*Primary Examiner*—Joseph Man-Fu Moy

*Attorney, Agent, or Firm*—Foley & Lardner, Schwartz, Jeffery, Schwaab, Mack, Blumenthal & Evans

[57] ABSTRACT

A key case for a key integrally having a tab to be gripped and a shaft to be inserted in a keyhole. The key case comprises a container capable of detachably containing the tab of the key, and having an opening through which the shaft of the key projects outside when the tab of the same is contained in the container. The key case facilitates gripping the tab of the key and provides the key with a decorative appearance.

1 Claim, 3 Drawing Sheets

KEY CASE

BACKGROUND OF THE INVENTION

The present invention relates to a novel key case.

Keys each having a flat tab and a shaft formed integrally with the flat tab so as to be inserted in a keyhole are used widely for operating the locks of automobiles, safes and doors of houses.

A conventional key case comprises a metallic ring which is inserted through an opening formed in the tab of a key, and a protective cover, such as a leather cover, for wrapping the key.

A key case in accordance with the present invention is a novel key case which is entirely different in idea and construction from the conventional key case.

SUMMARY OF THE INVENTION

It is an object of the present invention to provide a novel key case facilitating gripping the tab of a key so that the key can easily be handled and, if necessary, capable of enhancing the aesthetic appearance of the key and providing the key with the appearance of high quality.

To achieve the object of the invention, the present invention provides a key case for holding a key comprising a tab and a shaft formed integrally with the tab so as to be inserted in a keyhole, comprising a container capable of detachably accommodating the tab of the key and provided with an opening through which the shaft of the key is able to project outside when the tab of the same is contained in the container.

The key case in accordance with the present invention further facilitates gripping the key at the tab thereof to improve facility in handling the key. Furthermore, the use of a noble metal, such as gold, silver or the like, for forming the key case enhances the aesthetic appearance and apparent quality of an ordinary key. Such a key case is suitable for a high-grade automobile.

BRIEF DESCRIPTION OF THE DRAWINGS

FIGS. 1 to 3 are perspective views of a key case (1), in a first embodiment, according to the present invention, in which FIG. 1 shows the key case (1) in an open state, Fig. 2 shows the key case (1) in an open state with a key (40) contained therein and FIG. 3 shows the key case (1) in a closed state with the key (4) contained therein;

DETAILED DESCRIPTION OF THE INVENTION

Figure 1:
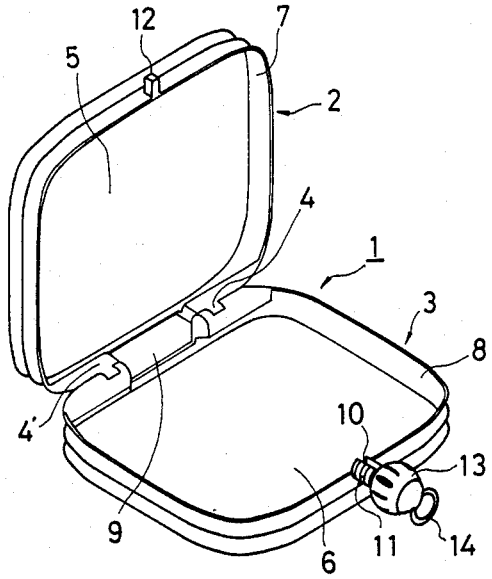
Figure 2:
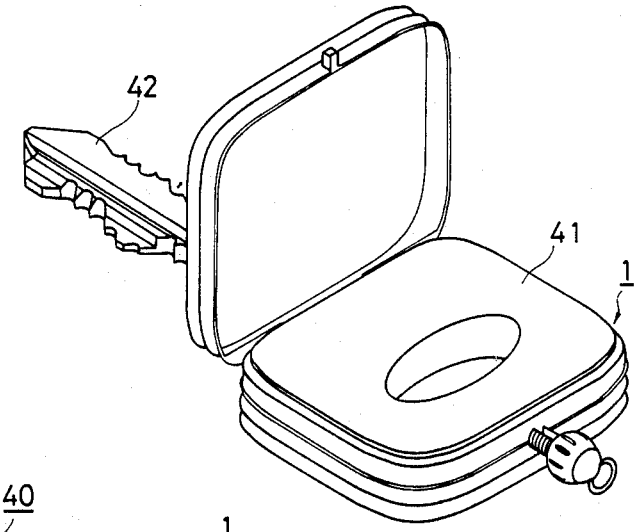
Figure 3:
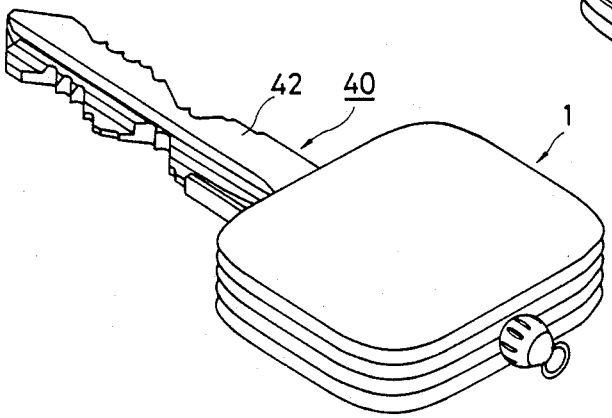
Figure 4:
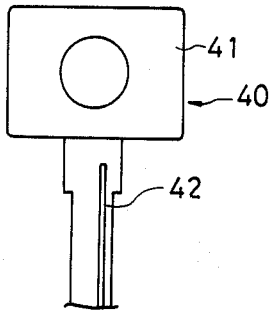
FIG. 4 is a front elevation of an exemplary key.

Referring to FIGS. 1 to 3 illustrating a key case 1, in a first embodiment, according to the present invention, the key case 1 comprises an upper cap 2 and a lower cap 3 hinged on hinges 4 and 4' to the upper case 2. The upper cap 2 has a bottom plate 5 and a side wall 7, and the lower cap 3 has a bottom plate 6 and a side wall 8. The upper cap 2 and the lower cap 3 have a size to contain the tab 41 of a key 40 shown in FIG. 4 closely substantially without any gap therebetween. Although the tab 41 of this key 40 is coated with a plastic material to provide a thick tab, the tab 41 need not necessarily be coated with a plastic material. A key case for containing a key having a thin tab may be formed so that the size of a gap between the perspective inner surfaces of the bottom plates 5 and 6 thereof corresponds to the thickness of the tab of such a key. A portion of the side wall 7 of the upper cap 2 between the hinges 4 and 4' is cut to form an opening 9 for receiving the shaft 42 of the key 40 therethrough in containing the key 40 in a state as illustrated in FIGS. 2 and 3. An externally threaded projection 11 having a groove 10 projects outward from the side wall 8 of the lower cap 3 at a position opposite the hinges 4 and 4'. A small projection 12 having a shape fitting the groove 10 of the projection 11 of the lower cap 3 projects outward from the side wall 7 of the upper cap 2 at a position corresponding to the position of the projection 11 of the lower cap 3. An external thread matching the external thread formed in the projection 11 is formed in a portion of the outer surface of the projection 12 which is exposed when the projection 12 is received closely in the groove 10 of the projection 11. An internally threaded cap nut 13 engages the projection 11 so as to be retained on the projection 11 and so as to be axially movable in a predetermined range relative to the projection 11. In containing the key 40 in the key case 1, the shaft 42 of the key 40 is inserted through the recess 9 so as to project outside and the tab 41 of the key 40 is placed in the lower cap 3 as shown in FIG. 2, the upper cap 2 is closed, and then the upper cap 2 and the lower cap 3 are fastened together by fastening the cap nut 13 to contain the key 40 firmly in the case 1 as shown in FIG. 3. The key case 1 is formed so that the size and shape of the internal space thereof coincide with those of the tab 41 of the key 40. Therefore, the key 40 is held firmly by the key case 1, which facilitates handling the key 40 together with the key case 40. A suitable chain or the like is attached to a ring 14 provided on the cap nut 13.

Various modifications of the first embodiment are possible. For example, a snap fastener may be employed for fastening the upper and lower caps together instead of the projection 11, the small projection 12 and the cap nut 13. Furthermore, the upper and lower caps may be fastened together only with a snap fastener without using any hinge. Still further, it is possible to fasten the upper and lower caps together by forming guide rails on the edge of either the upper cap or the lower cap and guide grooves in the edge of the other, engaging the guide rails and the guide grooves and sliding the upper and lower caps sideways relative to each other.

Figure 6:
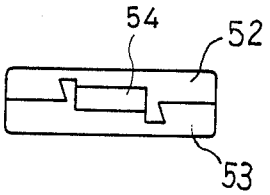
FIG. 6 is a fragmentary front elevation of the key case of FIG. 5.
Figure 5:
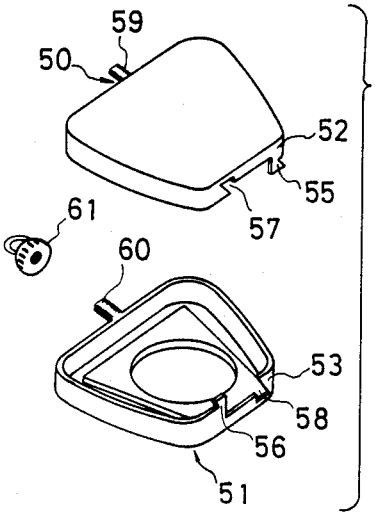
FIG. 5 is an exploded perspective view of a key case, in a second embodiment, according to the present invention.

Referring to FIG. 5, a key case, in a second embodiment, according to the present invention has an upper cap 50 and a lower cap 51. Recesses are formed in the respective side walls 52 and 53 of the upper cap 50 and the lower cap 51, respectively, so as to form an opening 54 as shown in FIG. 6 for receiving the shaft of a key therethrough when the upper cap 50 and the lower cap 51 are joined together. Dovetail projections 55 and 56 and dovetail recesses 57 and 58 respectively corresponding to the dovetail projections 56 and 55 are formed in the side walls 52 and 53 of the upper cap 50 and the lower cap 51, respectively. Externally threaded projections 59 and 60 project outward from the side walls of the upper cap 50 and the lower cap 51 at positions opposite the recesses forming the opening 54, respectively. When the upper cap 50 and the lower cap 51 are combined with each other, the projections 59 and 60 are joined together to construct a screw. Then, a cap nut 61 is screwed on the screw formed of the projections 59 and 60 to fasten the upper cap 50 and the lower cap 51 together so that a key is contained firmly in the key case.

Figure 7:
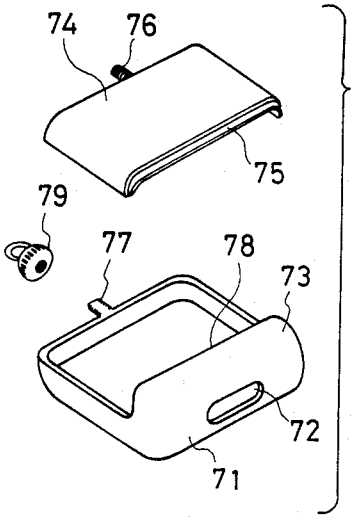
FIG. 7 is an exploded perspective view of a key case, in a third embodiment, according to the present invention.

Referring to FIG. 7, a key case, in a third embodiment, according to the present invention has a lower cap 71 having a covering wall 73 formed in part of the side wall thereof so as to cover partially the tab of a key contained in the key case. An opening 72 for receiving the shaft of the key therethrough is formed in the covering wall 73. A tongue 75 is formed in the edge of an upper cap 74 corresponding to the edge 78 of the covering wall 73 so as to project below and engage the edge 78 of the covering wall 73 when the upper cap 74 and the lower cap 71 are joined together. Externally threaded projections 76 and 77, which are similar to those of the second embodiment shown in FIG. 5, projects outward from the respective side walls of the upper cap 74 and the lower cap 71. A cap nut engages the externally threaded projections 76 and 77 to fasten the upper cap 74 and the lower cap 71 together.

Figure 8:
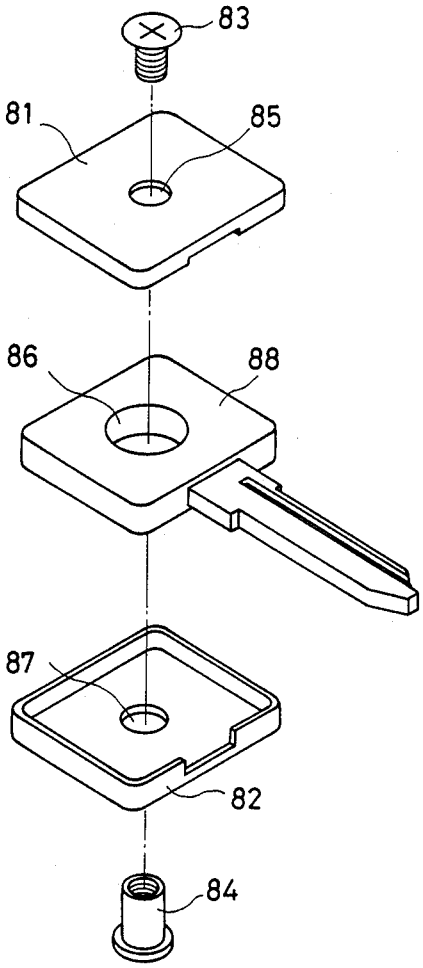
FIG. 8 is an exploded perspective view showing a key case, in a fourth embodiment, according to the present invention in combination with a key.

Referring to FIG. 8, a key case, in a fourth embodiment, according to the present invention, the key case comprises an upper cap 81, a lower cap 82, a screw 83 and a nut 84. The screw 83 is inserted through holes 85, 86 and 87 respectively formed in the upper cap 81, the tab 88 of a key and the lower cap 82 and is screwed in the nut 84 to fasten the upper cap 81, the key and the lower cap 82 together.

Figure 9:
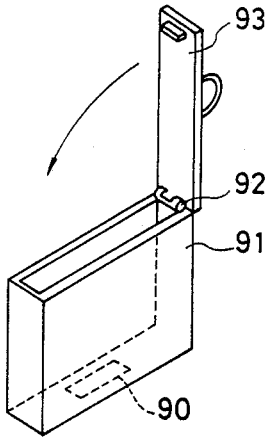
FIG. 9 is a perspective view of a key case, in a fifth embodiment, according to the present invention.
Figure 10:
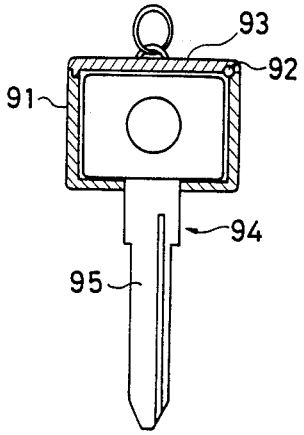
FIG. 10 is a longitudinal sectional view of the key case of FIG. 9 containing a key therein.

Referring to FIGS. 9 and 10, a key case, in a fifth embodiment, according to the present invention comprises a casing 91 and a cap 93 hinged to the casing 91 with a hinge 92. An opening 90 for receiving the shaft 95 of a key 94 is formed in the bottom wall of the casing 91. After receiving the tab of the key 94 in the casing 91, the cap 93 is closed and is held in place by a snap fastener.

It is desirable to apply an elastic material such as sponge or the like to the inner surface of the upper and lower caps of the fourth embodiment shown in FIG. 8 and the inner surface of the casing 91 of the fifth embodiment shown in FIGS. 9 and 10 to hold the tab of the key securely in the key case.

Although there is no any restriction on material for forming the key case of the present invention and the key case may be formed of a metal, such as gold, silver, platinum, copper, iron, aluminum, an alloy containing one or a plurality of those metals, a plastics, a fiber reinforced material or a hard rubber, it is preferable to use a noble metal, such as gold, silver, platinum or an alloy of these noble metals, for forming the key case to provide the key case with a highly aesthetic appearance and the appearance of a quality key case.

Although the invention has been described in its preferred forms with a certain degree of particularity, obviously many modifications and variations of the present invention are possible in the light of the above teachings. It is therefore to be understood that the invention may be practiced other wise than as specifically described without departing from the scope and spirit thereof.

What is claimed is:

1. A key case for a key integrally having a tab to be gripped and a shaft to be inserted in a keyhole, comprising:

a container capable of detachably containing the tab of the key, and having an opening through which the shaft of the key projects outside when the tab of the key is contained therein;

said container comprises an upper cap having a first plate and a first side wall extending along the periphery of the first plate, and a lower cap having a second plate and a second side wall extending along the periphery of the second plate, and recesses are formed in the side walls so as to form said opening when the upper and lower caps are joined together;

said upper and lower caps are coupled with each other by means of a pair of hinges formed in the respective corresponding side walls thereof, and said recesses are formed between the pair of hinges; and an externally threaded projection provided with an axial groove projects outward from the side wall of the lower cap opposite the side wall of the same in which said hinges are provided, a projection projects outward from the side wall of said upper cap corresponding to the side wall of said lower cap from which the former projection projects so as to fit the groove of the former projection when said upper and lower caps are joined together, and an internally threaded cap nut is screwed on said projections to fasten said projections together.

* * * * *